US005352186A

United States Patent [19]

Yamasaki et al.

[11] Patent Number: 5,352,186

[45] Date of Patent: Oct. 4, 1994

[54] FINGER PRESSURE DEVICE

[75] Inventors: Yoshikiyo Yamasaki, Sakai; Shinichiro Fujimoto, Osaka, both of Japan

[73] Assignees: Kabushiki Kaisha Japan Health; Kabushiki Kaisha Fuji Tryoki, Osaka, Japan

[21] Appl. No.: 97,578

[22] Filed: Jul. 26, 1993

Related U.S. Application Data

[63] Continuation of Ser. No. 832,937, Feb. 10, 1992, abandoned.

[51] Int. Cl.[5] ..... A61H 1/00; A61H 7/00

[52] U.S. Cl. ..... 601/99; 601/116

[58] Field of Search ..... 297/284.7; 601/51, 52, 601/93, 94, 97–99, 101, 102, 115, 116, 96

[56] References Cited

U.S. PATENT DOCUMENTS

| | | | |
|---|---|---|---|
| 3,322,116 | 5/1967 | Murphy et al. | 128/33 |
| 3,763,853 | 10/1973 | Jochimski | 128/36 |
| 4,230,098 | 10/1980 | Uematsu | 128/33 |
| 4,574,786 | 3/1986 | Hashimoto et al. | 601/59 |
| 4,576,149 | 3/1986 | Otuka et al. | 128/33 |
| 4,615,336 | 10/1986 | Fijimoto . | |
| 4,718,408 | 1/1988 | Barreiro | 128/57 |
| 5,020,518 | 6/1991 | Spears et al. | 601/102 X |
| 5,052,376 | 10/1991 | Yamasaki | 128/33 |
| 5,094,225 | 3/1992 | Craw | 128/33 X |

FOREIGN PATENT DOCUMENTS

| | | | |
|---|---|---|---|
| 984251 | 2/1976 | Canada | 128/33 |
| 3712085 | 10/1987 | Fed. Rep. of Germany | 128/36 |

*Primary Examiner*—Robert A. Hafer
*Assistant Examiner*—Brian E. Hanlon
*Attorney, Agent, or Firm*—Flynn, Thiel, Boutell & Tanis

[57] ABSTRACT

A finger pressure device for massaging includes a box having a pair of framelike slidable holding trunks provided on opposite sides thereof, a starting motor fixed in the center of the box and having a hollow starting shaft with a female screw part inside, and a T-shape supporting bar having a rear part with a supporting male screw part which engages with the female screw part of the starting motor. The forward part of the T-shape supporting bar has a pair of opposed finger pressure disks on opposite sides thereof. A pair of slidable holding plates can slide inside the slidable holding trunks and their ends are connected to the outer ends of holding parts of the finger pressure disks. The T-shape supporting bar extends and retracts by rotation of the starting shaft in one direction or the reverse direction, and each finger pressure disk extends and retracts repeatedly.

3 Claims, 6 Drawing Sheets

FINGER PRESSURE DEVICE

This application is a continuation of U.S. Ser. No. 07/832,937, filed Feb. 10, 1992, abandoned.

FIELD OF THE INVENTION

This invention relates to a device for giving finger pressure motion massage by extending or retracting a pair of finger pressure disks.

More specifically, this invention relates to a finger pressure device for giving finger pressure massage or rubbing finger pressure massage to the user which transmits the rotation of the drive shaft of a drive motor for finger pressure directly to supporting screw bars to extend and retract a pair of finger pressure disks so that they contact with and separate from the body of the user.

BACKGROUND OF THE INVENTION

Description of Prior Art

Many kinds of massagers which massage parts of the human body have been developed.

For example, a massager which can optionally give rubbing massage, patting massage and sliding massage, and so on, on parts of the human body, by providing a screw shaft, which can rotate in one direction and a reverse direction, in the seat back of the chair or the bed and into engagement with the massager, can give repeated horizontal motion and repeated vertical motion by pair of massaging balls attached to the screw shaft and is convenient for many users because of its good effects.

Recently, a finger pressure massager which can give pushing massage on the pressure points of the human body by the extension and retraction of finger pressure balls have been requested and developed.

However, most finger pressure massagers which have been developed have structures requiring motors to start cams and rotations of the cams make the finger pressure balls, equipped above the cams, extend and retract.

There is not a holding structure between the cams and finger pressure balls, therefore, there is a problem that the finger pressure balls cannot extend and retract because the finger pressure balls do not contact the cams and the cams run idle in some angles of use.

PRIOR ART

To overcome the above-discussed problems, the inventor of this application invented and manufactured the finger pressure device for massage disclosed in Japanese Patent Application : Heisei 1 - No. 14050.

However, in the above-mentioned finger pressure massager, the motor for finger massage is provided below the structural frame, rotation of the motor passes through the slave shaft and the main driving axle to the guide plates, and then passes through the floating pins to the slidable plates to make the finger pressure balls extend and retract.

This massager requires many components and the structure is complicated. Therefore, there are problems of the noise of the transmission parts and trouble from the transmission components.

Further, the device of the conventional structure described above is of a large scale because of its linkage components. Therefore, miniaturization is impossible.

Consequently, development of a finger pressure device which has a simple transmission structure, can be manufactured inexpensively and is of a small-size and light weight has been requested strongly. However, the means which meet the requirement has not been developed yet.

SUMMARY OF THE INVENTION

The present invention was made in view of the above circumstances. It excludes the idea of drive transmissions and is made in view of new technical ideas.

An object of this invention is to provide a small-sized and light weight finger pressure device which can provide finger pressure massage to the user by extending and retracting a pair of pressure balls by directly transmitting the rotation, in one direction or the reverse direction, of the starting shaft of the starting motor to the supporting screw bar which makes the finger pressure disks extend and retract.

A further object of this invention is to provide a finger pressure massaging device which can provide rubbing finger pressure massage to the user by setting the center parts of a pair of finger pressure disks at right and left sides of the supporting bar so that the finger pressure disks contact with and separate from the user's body interlockingly with the extension and retraction of the supporting screw bar.

A still further object of this invention is to provide a finger pressure massage device which has a pair of finger pressure disks which can extend and retract or contact with and separate from the seat back of the chair and the finger pressure device can raise and lower along the chair back, the locus of movement of a pair of finger pressure disks is changeable and the user can choose the locus of a pair of finger pressure disks properly.

DETAILED DESCRIPTION

This invention is made up of a box which has a pair of framelike slidable holding trunks provided on opposite sides thereof and a starting motor fixed in the center of the box. The shaft of the motor is hollow and has a female screw part located inside of it. A T-shape supporting bar has a rear part with a supporting male screw part, which engages with the female screw part of the starting motor, and a forward part with a pair of opposed finger pressure disks provided thereon. A pair of slidable holding plates, which can slide inside the slidable holding trunks, have ends which are connected to the outer ends of the T-shape supporting bar forward part with the finger pressure disks.

The T-shape supporting bar extends and retracts through the rotation in one direction or the reverse direction of the starting shaft and each finger pressure disk extends and retracts repeatedly.

Figure 1:
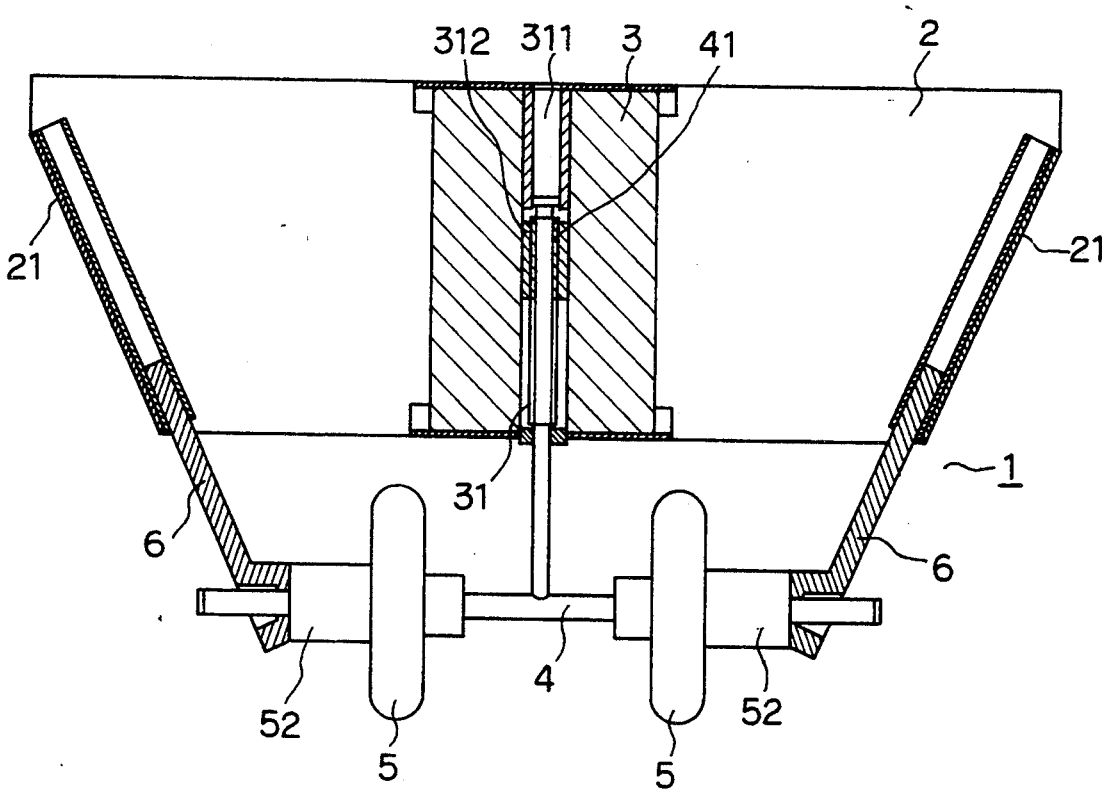
FIG. 1 is the central vertical sectional view of an embodiment of this invention.
Figure 2:
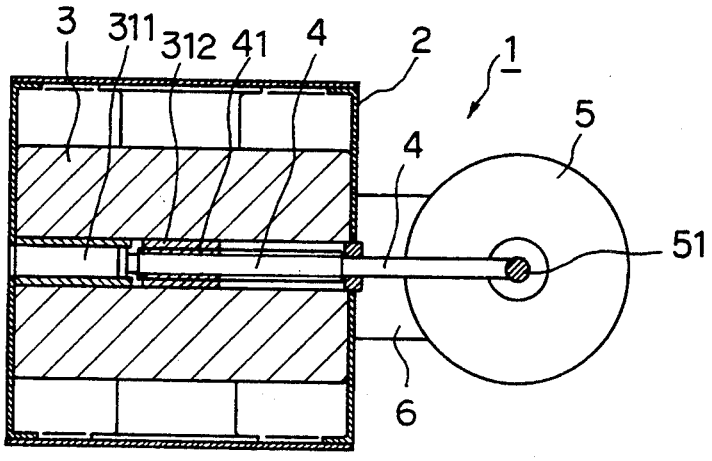
FIG. 2 is the central transverse sectional view of an embodiment of this invention.

FIG. 1 and FIG. 2 are embodiments of the finger pressure device 1 of this invention.

The finger pressure device 1 consists of a box 2 which has a pair of framelike slidable holding trunks 21 provided on opposite sides thereof and a starting motor 3 fixed in the center of the box 2. A T-shape supporting bar 4 can extend or retract by rotation in one direction or the reverse direction of the starting shaft 31 of the starting motor 3 and finger pressure disks 5 are provided on a forward part of the T-shape supporting bar 4.

The box 2 can be formed like a square (from plan view) or trapezoid (from plan view) having an opened front part and, if it is needed, whose rear part is also opened (see FIGS. 1 and 2).

The slidable holding trunks 21, which are framelike rectangular parallelopipeds which can slidably hold the slidable holding plates 6, are fixed onto opposite sides of the box 2.

In the drawings, the slidable holding trunks 21 are fixed diagonally onto opposite, inwardly inclined sides of the box 2, which is of trapezoidal configuration (from plan view), thereby enabling the slidable holding plates 3 to extend diagonally in the narrower direction of the box 2 and retract.

The starting motor 3 is fixed in the center of the box 2 and the starting shaft 31 is provided at the center of the starting motor 3 and rotates in a first direction or a reverse direction by the starting motor 3.

The starting shaft 31 is hollow and a female screw part 312 is provided inside the hollow part 311.

The T-shape supporting bar 4 engages the female screw part 312 through a male screw part 41 which thereby enables the T-shape supporting bar 4 to extend and retract depending on the rotation of starting shaft 31. There is no need to make the female screw part extend throughout the hollow part 311. It is enough to make the female screw part 312 inside a portion of the starting shaft 31 (not shown), and the T-shape supporting bar can engage the female screw part 312 directly.

The T-shape supporting bar 4 has two round bar members, one round bar member comprises a rear part containing a male screw part 41 which can engage the female screw part 312. Through the engagement of the male screw part 41 with the female screw part 312 of the starting shaft 31, the T-shape supporting bar 4 can extend and retract in a certain range by rotation in one direction or reverse direction of the starting motor 3.

The finger pressure disk 5 is formed like a disk or a ball which has an insert hole 51 at its center and the holding parts 52 are located outside of the disks 5.

The finger pressure disks 5 are set up opposingly with the T-shape supporting bar 4 inserted into the insert holes 51 with the holding parts 52 of the finger pressure disks 5 located outside both sides of the orthogonal point (crossing position) of the T-shape supporting bar 4.

The finger pressure disks 5 extend and retract interlockingly with the extension and retraction of the T-shape supporting bar 4.

The slidable holding plate 6 is, for example, formed like a plate, and one end of the plate is inserted into the slidable holding trunk 21 and the other end of the plate 6 is connected to the outer end of holding part 52 of the finger pressure disk 5.

A pair of slidable holding plates 6 slide in the slidable holding trunks 21 during the extension and retraction of the T-shape supporting bars 4 and holds and guides the finger pressure disks 5. In the drawings, the slidable holding plates 6 are inserted into the slidable holding trunks 21, which are fixed diagonally onto opposite sides of the trapezoid (from plan view) box 2.

Using the box 2, a pair of slidable holding lats 6 are guided and slide in the slidable holding trunks 21 and the plates extend toward the narrower direction of the front and retract. Therefore, the finger pressure disks 5•5 connected to the outer ends of slidable holding plates 6•6 can extend and retract to contact and separate from the user's body repeatedly.

When the user uses the finger pressure device 1 of this invention as described above, the T-shape supporting bar 4 extends and retracts by the rotation in one direction or reverse direction of the starting shaft 31 of the starting motor 3, the slidable holding plates 6•6 slide to extend and retract interlockingly with the T-shape supporting bar 4 along the slidable holding trunks 21•21 fixed on both sides of the square (from plan view) box 2.

The finger pressure disks 5•5 connected to the slidable holding plates 6•6 can extend and retract repeatedly.

The user places one's affected part on the position where the finger pressure disks 5 extend and retract and the finger pressure massage by the finger pressure disks 5 can be given.

When the box 2 is trapezoidal (from plan view), the T-shape supporting bar 4 extends and retracts by rotation in one direction or reverse direction of the starting shaft 31 of the starting motor 3, the slidable holding plates 6•6 slide to extend and retract interlockingly with the T-shape supporting bar toward the diagonal front direction or diagonal rear direction along the slidable holding trunks 21•21, which are fixed onto opposite sides of the box 2, thereby enabling the finger pressure disks 5•5 connected to the slidable holding plates 6•6 to extend and retract or contact and separate from the user's body.

When the user places one's affected part at the position where the finger pressure disks 5 extend and retract, the rubbing finger pressure massage by the finger pressure disks 5 can be given.

FIG. 3 to FIG. 7 illustrate another embodiment of the finger pressure device 1 of this invention which can raise and lower. This embodiment is made up of the box 2, which has a pair of framelike slidable holding trunks 21 on opposite sides thereof, and the starting motor 3 fixed in the center of the box 2. The T-shape supporting bar 4 extends and retracts by the rotation in one direction or the reverse direction of the starting shaft 31 of the starting motor 3 and the finger pressure disks 5 are provided on the T-shape supporting bar 4.

Figure 3:
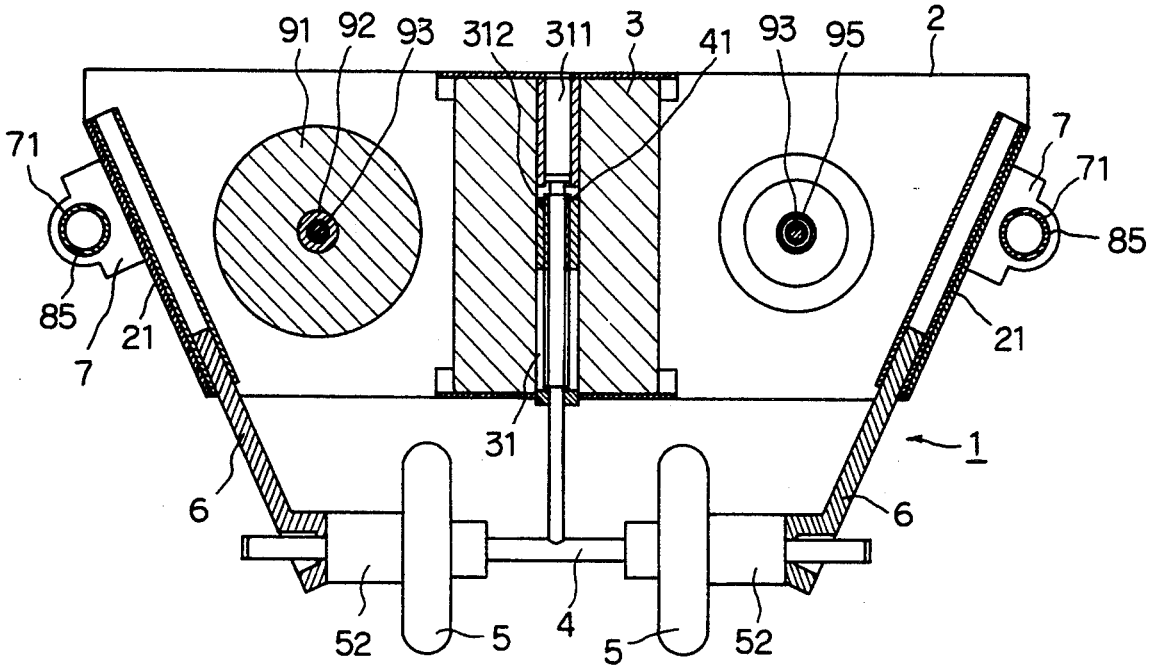
FIG. 3 is the explanatory view of another embodiment of this invention.
Figure 5:
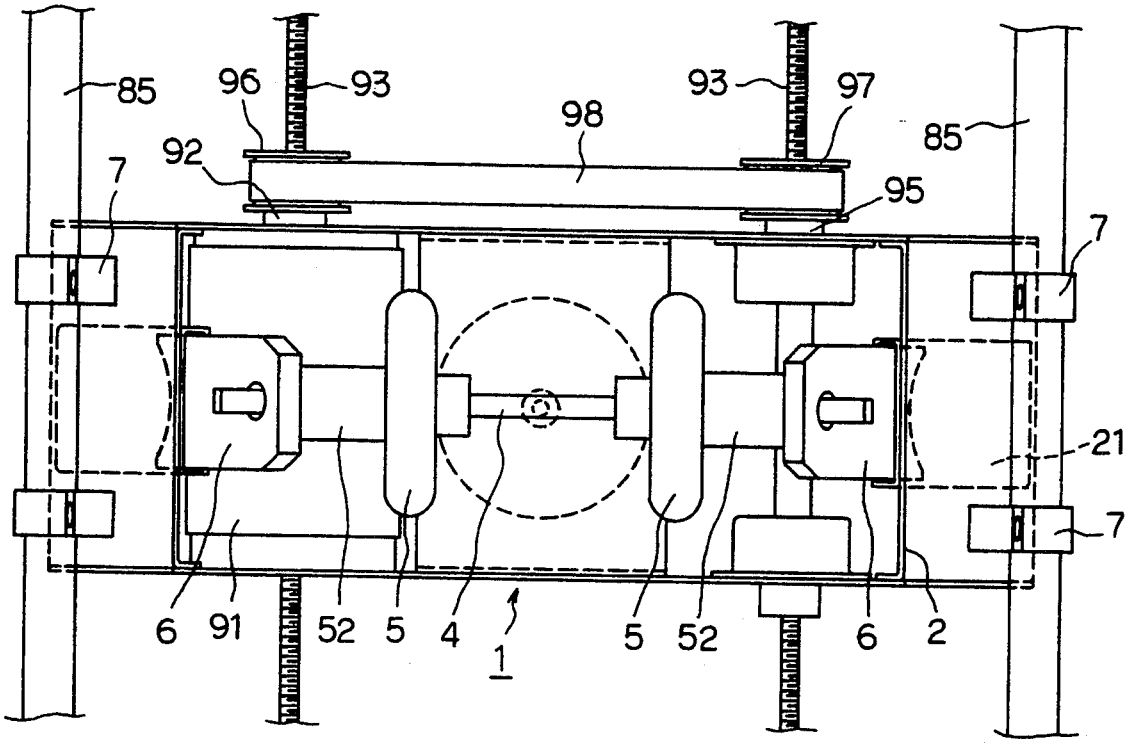
FIG. 5 is the explanatory view of another embodiment of this invention.
Figure 6:
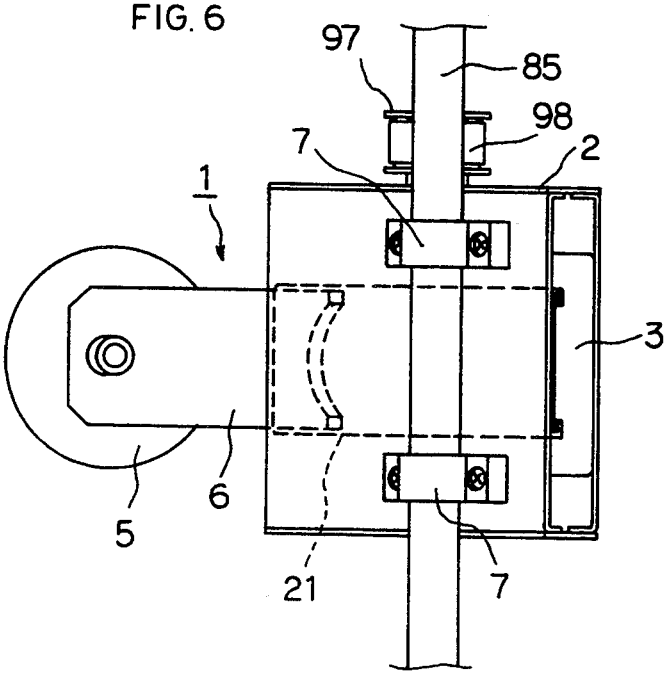
FIG. 6 is the explanatory view of another embodiment of this invention.
Figure 7:
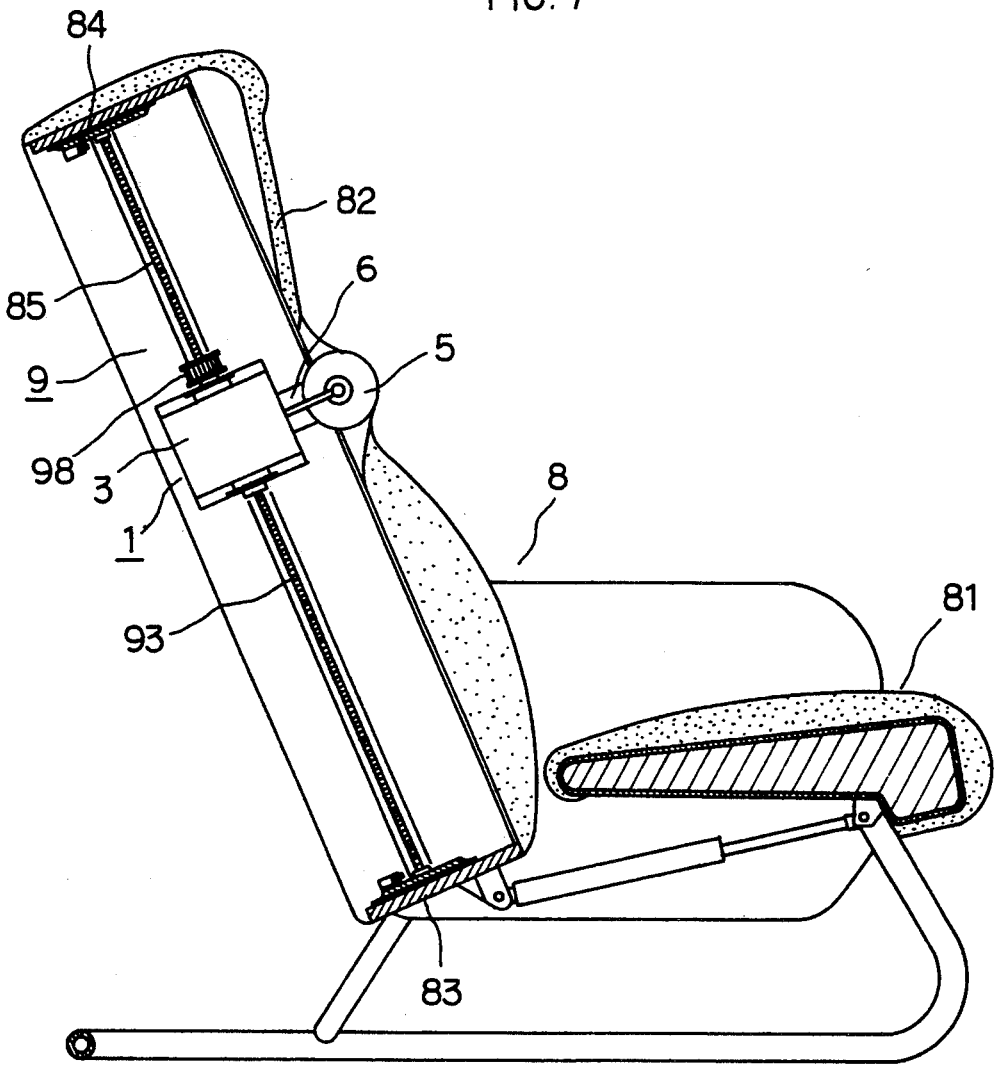
FIG. 7 is the central vertical sectional view of another embodiment of this invention.

As shown in FIG. 7, the finger pressure device 1 is connected to a pair of parallel supporting guide bars 85•85 which are equipped between the base plate 83 and the roof plate 84 in the seat back 82 of the massage chair 8 and through the elevator 9, the finger pressure device 1 raises and lowers repeatedly along the supporting guide bars 85. That is, numeral 7 of FIG. 3, FIG. 5 and FIG. 6 are slidable guide cylinders through which is inserted the supporting guide bars 85, and the slidable guide cylinders are fixed on both sides of the box 2 of the finger pressure device 1. The insert hole 71, through which the supporting guide bar is inserted, is made in the center of the slidable guide cylinder 7. The supporting guide bars 85•85 are inserted into the insert holes 71 of the slidable guide cylinders 7 and the finger pressure device 1 raises and lowers between the base plate 83 and the roof plate 84 while being held between the supporting bars 85•85.

The finger pressure device 1 is connected with the elevator structure 9 between the base plate 83 and the roof plate 84, and the finger pressure device 1 raises and lowers automatically along the supporting guide bars 85.

Figure 4:
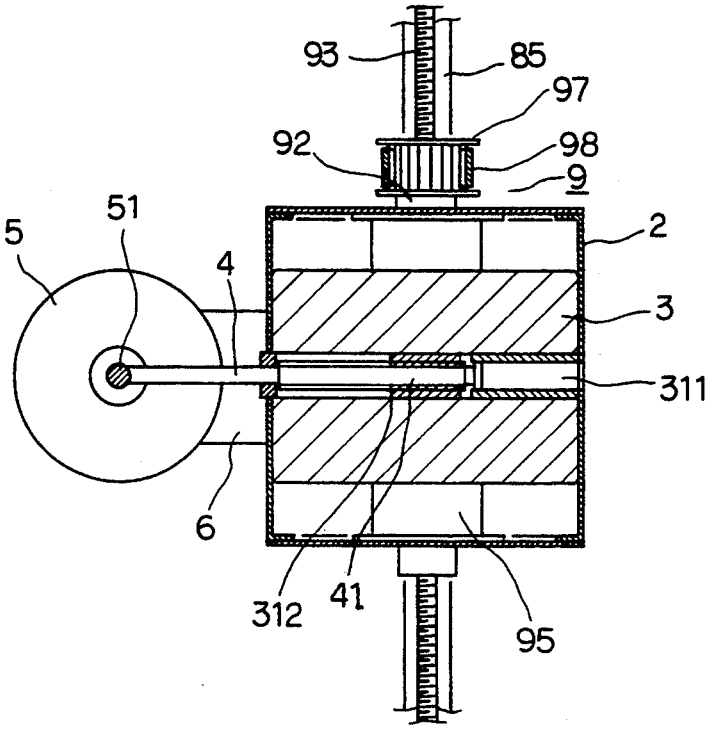
FIG. 4 is the explanatory view of another embodiment of this invention.

As shown in FIGS. 3 to 7, the elevator structure 9 has a drive motor 91 for raising and lowering equipped to one side of the box 2 of the finger pressure device 1 and the hollow driving screw tube 92, which rotates in the center of the drive motor 91 for raising and lowering and the thin screw bars 93, whose upper ends and lower ends are fixed on the base plate 83 and the roof plate 84, have a center part inserted into the hollow driving screw tube 92. As shown in FIGS. 3 and 4, the drive motor for raising and lowering is provided at the right or leftside of the box 2.

The hollow driving screw tube 92 is hollow and a female screw part is provided therein which engages with the thin screw bars 93 so when the hollow driving screw tube 92 rotates in one direction or in a reverse direction by the driving motor 91, the whole of the box 2 raises and lowers along supporting guide bars 85 by the thin screw bar 93, which engages the hollow driving screw tube 92.

As shown in FIGS. 4 and 5, the thin screw bar 93 is the thin bar member which has a male screw part 94 provided on its outside surface. In the drawings, a pair of the thin screw bars 93 are provided on right and left sides between the base plate 83 and the roof plate 84, although, to enable the box 2 to raise and lower stably, the thin screw bars may be equipped on only one side of the drive motor 91 for raising and lowering.

As shown in FIG. 4, when a pair of thin screw bars 93 are provided on the side of the box 2, the rotating cylinder 95 can rotate supported by bearings above and below the box 2.

96 is a pulley fixed around the upper end of the hollow driving screw tube 92 and 97 is the pulley fixed around the upper end of the rotating cylinder 95.

The endless belt 98 is set between the pulleys 96•97, which can rotate synchronously.

In this embodiment, the hollow driving screw tube 92 and the pulley 96 are provided above the drive motor 91 for raising and lowering. The pulley 97 location, however, is not limited and can be provided below the drive motor for raising and lowering.

When the user uses the finger pressure device of this application, the finger pressure disks 5•5 extend and retract repeatedly by rotation in one direction or the reverse direction of the starting shaft 31 of the starting motor 3, and finger pressure massage or rubbing finger pressure massage can be given.

The finger pressure device 1 can raise and lower optionally along supporting guide bars 85 by the elevator structure 9. It can be placed at the desired position of the back of the user sitting in the massage chair 8, and finger pressure massage or rubbing finger pressure massage can be given.

Figure 8:
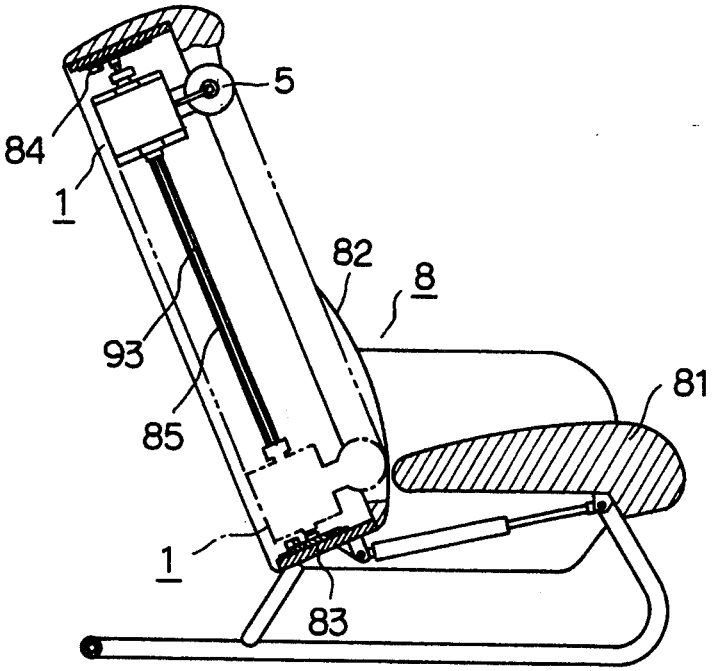
FIG. 8 is the explanatory view of this invention in use.
Figure 9:
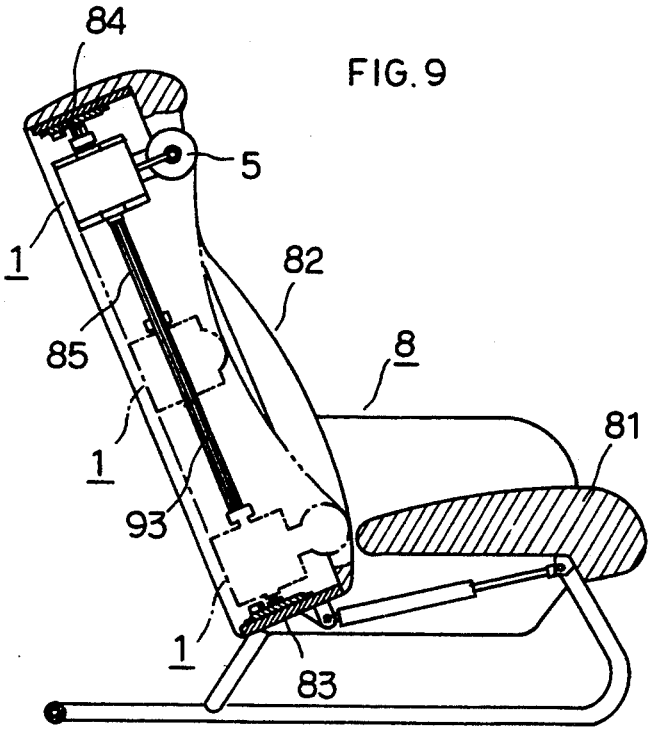
FIG. 9 is the explanatory view of this invention in use.
Figure 10:
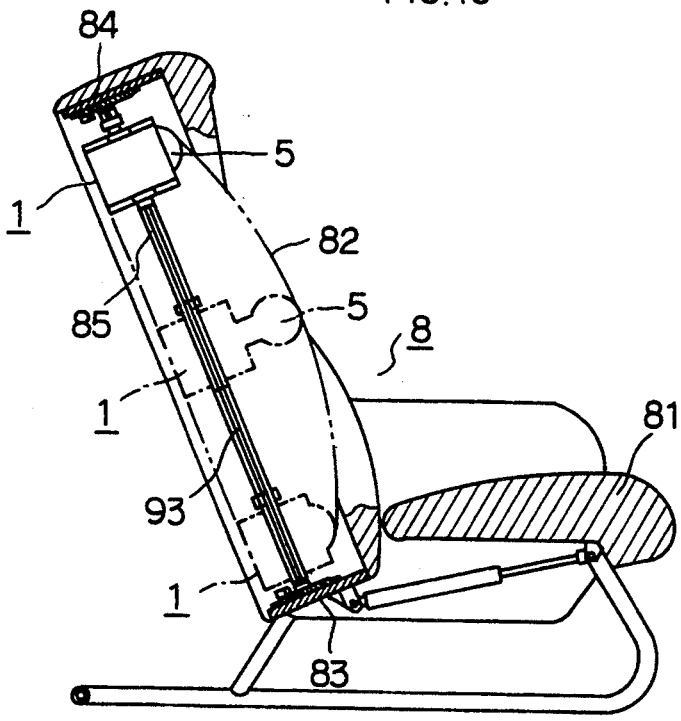
FIG. 10 is the explanatory view of this invention in use .

As shown in FIGS. 8 to 10, the cycle of extension and retraction of the finger pressure device can be set properly, and the locus of movement of a pair of finger pressure disks 5 can be changed by raising and lowering of the elevator structure 9. For example, when the finger pressure disks raise and lower repeatedly by stopping the starting motor 3, as shown in FIG. 8, rolling massage can be given in a straight line to the user sitting in the massage chair.

As shown in FIG. 9, the starting motor 3 is set for the T-shape supporting bar 4 to extend out at upper and lower locations and retract at a center location, and the finger pressure disks raise and lower with the elevator structure 9 so that rolling massage, which can give strong finger pressure to the nape and waist of the user, is applied.

As shown in FIG. 10, the starting motor 3 is set for the T-shape supporting bar 4 to retract at the upper and lower locations and to extend at a center location, and the finger pressure disks raise and lower with the elevator structure 9 so that rolling massage, which can give strong finger pressure to the center of the back of the user, is applied.

In the finger pressure device of this invention, the T-shape supporting bar engages the starting motor, which has a starting shaft which is hollow, and inside of which a female screw part is provided. Rotation in one direction or the reverse direction of the starting shaft of the drive motor for finger pressure can be transmitted directly, thereby enabling the finger pressure disks to extend and retract easily.

Accordingly, the inventive device is different from the conventional finger pressure massagers which have finger pressure disks extending and retracting by rotation of the motor for finger pressure through many transmission shafts and components. The inventive structure is simple, doesn't cause noise from transmission components, is small-sized and of light weight and manufacturing costs can be reduced, making it very valuable.

Consequently, this invention solves the conventional various defects and problems, satisfies various requirements, changes the basic idea of a finger pressure device, enables several kinds of finger pressure effects to be given and, therefore, is very useful.

We claim:

1. A finger pressure massaging device comprising:

a box having a pair of holding trunks provided on opposite sides of said box, a starting motor provided at a central location in said box, said starting motor having a hollow shaft with a female threaded part provided therein; a T-shaped supporting bar comprising a forward member and a rearward member joined to said forward member, the distal end of said rearward member having a male threaded part provided thereon, said male threaded part being threadedly engaged with said female threaded part provided in said starting motor hollow shaft; a pair of finger pressure massaging disks provided on said T-shaped supporting bar forward member; and a pair of slidable plates provided at opposite ends of said T-shaped supporting bar forward member, said slidable plates being mounted for slidable movement inside said holding trunks, whereby rotation of said starting motor hollow shaft in a first direction causes said male threaded part provided on said T-shaped supporting bar to screw into said hollow shaft female threaded part and rotation of said starting motor hollow shaft in a second direction opposite to said first direction causes said male threaded part to screw out of said hollow shaft female threaded part, thereby causing said T-shaped supporting bar, and said pair of finger pressure massaging disks provided thereon, to move toward or away from said starting motor, said box being slidably supported on a pair of parallel supporting guide bars fixed in a seat back of a massage chair and cooperable with an elevator structure so as to be raised and lowered along the supporting guide bars repeatedly by operation of the elevator structure, said elevator structure comprising a drive motor provided in said box for raising and lowering said box.

2. A device according to claim 1, wherein said pair of holding trunks are fixed into opposite sides of the box, which slant inwardly.

3. A device according to claim 1, wherein the female screw part is provided inside an end of the starting motor hollow shaft.

* * * * *

UNITED STATES PATENT AND TRADEMARK OFFICE

CERTIFICATE OF CORRECTION

PATENT NO. : 5,352,186
DATED : October 4, 1994
INVENTOR(S) : Yoshikiyo Yamasaki, et. al.

It is certified that error appears in the above-indentified patent and that said Letters Patent is hereby corrected as shown below:

Title page, item [73], Assignees, change "Kabushiki Kaisha Fuji Tryoki" to --Kabushiki Kaisha Fuji Iryoki--.

Column 8, line 8, replace "into" with --onto--.
replace "box," with --box--.

Signed and Sealed this

Seventh Day of March, 1995

*Attest:*

BRUCE LEHMAN

*Attesting Officer*

*Commissioner of Patents and Trademarks*